US006637609B2

(12) United States Patent
Stevens

(10) Patent No.: US 6,637,609 B2
(45) Date of Patent: Oct. 28, 2003

(54) PORTABLE STORAGE APPARATUS

(76) Inventor: Michael Dale Stevens, 2599 Aster Rd., Loveland, OH (US) 45140

( * ) Notice: Subject to any disclaimer, the term of this patent is extended or adjusted under 35 U.S.C. 154(b) by 0 days.

(21) Appl. No.: 10/097,829

(22) Filed: Mar. 14, 2002

(65) Prior Publication Data

US 2002/0190017 A1 Dec. 19, 2002

Related U.S. Application Data

(60) Provisional application No. 60/277,912, filed on Mar. 23, 2001.

(51) Int. Cl.[7] ..... A47F 5/00

(52) U.S. Cl. ..... 211/118; 211/149; 108/96; 108/149

(58) Field of Search ..... 211/118, 117, 211/113, 149; 108/96, 149

(56) References Cited

U.S. PATENT DOCUMENTS 1,448,539 A * 3/1923 Hopwood
1,847,066 A * 3/1932 Berg
2,244,887 A * 6/1941 Manley
2,389,910 A * 11/1945 Hoffmann
3,799,072 A * 3/1974 Slaboden ..... 108/149 X
3,904,258 A * 9/1975 Faulkenberry
4,187,787 A * 2/1980 Nakatsu ..... 108/96
4,195,739 A 4/1980 Sweet
4,327,836 A 5/1982 Okuno
4,329,789 A * 5/1982 Erickson ..... 211/113 X
4,523,526 A * 6/1985 O'Neill ..... 108/149
4,585,127 A 4/1986 Benedict
5,505,318 A 4/1996 Goff
5,533,534 A 7/1996 Cariello
5,542,530 A * 8/1996 Freelander ..... 108/96 X
5,692,604 A 12/1997 Houk
6,126,021 A * 10/2000 Wilhite ..... 211/113 X

* cited by examiner

*Primary Examiner*—Robert W. Gibson, Jr.

(57) ABSTRACT

A portable storage apparatus that suspends from a stationary object and neatly collapses into a compact form for easy storage and transport, consisting of fabric backing with a tapered top end housing four rigid shelves evenly spaced in front with four support rods attached to shelves providing rigid support and secure attachment to the fabric backing along with locking mechanisms under each shelf to maintain a horizontal angle and enhance shelf stability. A continuous cord passes through holes on one side of rigid shelves, through a back support bar, through grommets, forming a loop with hook, and back down the other side. The suspension allows for adjustable hanging height along with additional stability and support. Once unfolded in a hanging position, two support rods slide into vertical support rod access channels sewn into fabric backing along either side in the back.

16 Claims, 3 Drawing Sheets

PORTABLE STORAGE APPARATUS

CROSS-REFERENCE TO RELATED APPLICATIONS

This application is entitled to the benefit of Provisional Patent Application Ser. No. 60/277,912, filed Mar. 23, 2001.

STATEMENT REGARDING FEDERALLY SPONSORED RESEARCH AND DEVELOPMENT

Not Applicable.

BACKGROUND OF THE INVENTION

This invention relates to a hanging rack with shelves for storing items, specifically to a portable, lightweight rack used for storage that folds easily into a compact unit.

People who enjoy outdoor activity, such as backpacking and camping, usually carry only the essentials since unnecessary items can weigh them down, making the hike more difficult. Once at their destination, personal items are kept in the backpack or tent making it necessary to search through the pack when an item is needed. It seems that no matter how organized, there is always some searching and digging looking for one's sunglasses, flashlight, knife, and eating utensils, to name a few. A need exists for a portable, lightweight storage device that withstands outdoor conditions and provides easy access to frequently-used items. To date, this need has gone unfulfilled as a review and examination of the prior art will indicate.

U.S. Pat. No. 5,692,604 by Houk is a hanging storage device that organizes and stores various articles of clothing in transparent panels or pockets affixed to a flexible flat substratum. Each pocket stores various articles of clothing, potentially a plurality of items in one storage pocket. However, the more articles which are stored in a given location, the greater the difficulty in locating a particular item. This makes it necessary to search through individual compartments. Convenient access and visibility are also limited in the dark. A grommet provides the means for suspension, directly supporting the weight of the apparatus itself and the articles of storage, thereby forcing the area around the grommet to handle the combined weight. This has the potential of reducing the life of the product through excess weight at one focal point and limiting the types of items capable of storing. It is apparent from this design that the hanging height of the rack is fixed. Also, while this storage device folds into a compact, portable form, repeated folding weakens the flexible substratum leading to a less rigid and stable structure over time.

A variety of other storage devices are provided in the prior art. U.S. Pat. No. 4,585,127 by Benedict, U.S. Pat. No. 4,327,836 by Okuno, U.S. Pat. No. 4,195,739 by Sweet, III, U.S. Pat. No. 5,505,381 by Goff, and U.S. Pat. No. 5,533,534 by Cariello et al. are all storage devices but each with a different purpose. While these units may be suitable for the particular purpose to which they address, they would not be suitable for the purposes of the present invention. A combination of attributes, including portability, compactness, durability, and ease and convenience of use are required to meet the purported need.

BRIEF SUMMARY OF THE INVENTION

A portable storage apparatus comprising a fabric backing of sufficient size to house a plurality of rigid shelves and a plurality of support rods, suspended vertically from a stationary object using a continuous cord with a hook.

A primary object of the present invention is to provide a portable storage apparatus that will overcome the shortcomings of the prior art devices.

Another object is to provide a portable storage apparatus with rigid shelves that supports the placement of items of varying size and shape.

Yet another object is to provide a portable storage apparatus with clear visibility and quick and easy access to shelved items.

An additional object is to provide a portable storage apparatus with an adjustable suspension system that distributes the weight of the contents over the entire rectangular surface of the fabric backing and allows for adjustment of hanging height.

Yet another additional object is to provide a portable storage apparatus which is assembled so that it allows the rigid shelves to collapse into a folding position for compact storage and easy transport.

A further object is to provide a portable storage apparatus durable and rugged enough to withstand repeated use.

A still further object is to provide a portable storage apparatus that provides portable storage capabilities in any situation, but specifically designed with outdoorsmen in mind.

The invention as well as other objects and advantages thereof will become apparent from the following detailed description when considered with the accompanying drawings.

DETAILED DESCRIPTION OF THE INVENTION

Figure 1:
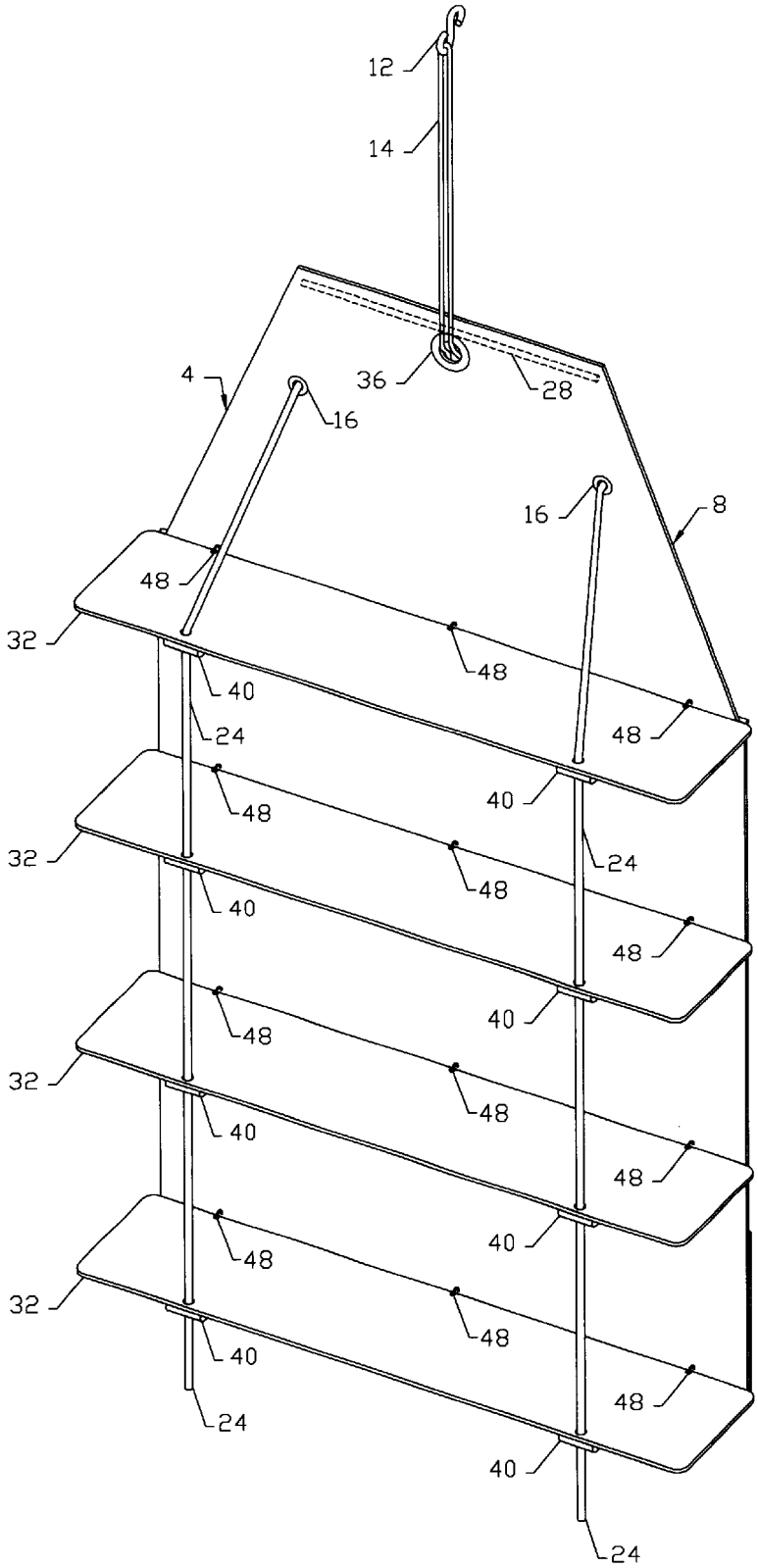
FIG. 1 is a front elevational view of a portable storage apparatus according to the teachings of the present invention.

Referring now to the drawing wherein like or similar elements are designed with identical reference numerals throughout the several views, wherein the elements depicted are not necessarily shown drawn to scale and, more particularly, to FIG. 1, there is shown an apparatus according to the teachings of the present invention (generally designated by reference number 4). The portable storage apparatus 4 depicted in FIG. 1 may be seen to comprise of four rigid shelves of rectangular shape 32 attached to a fabric backing tapered at the top end 8 where a forming rod and its enclosure 28 are attached to maintain shape.

Figure 3:
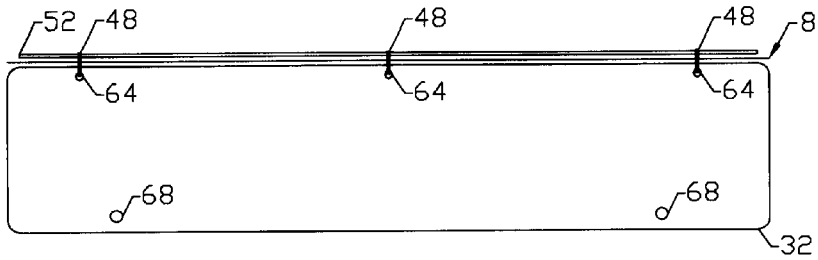
FIG. 3 is a detailed view of a rigid shelf and its means and points of attachment to the fabric backing.
Figure 5:
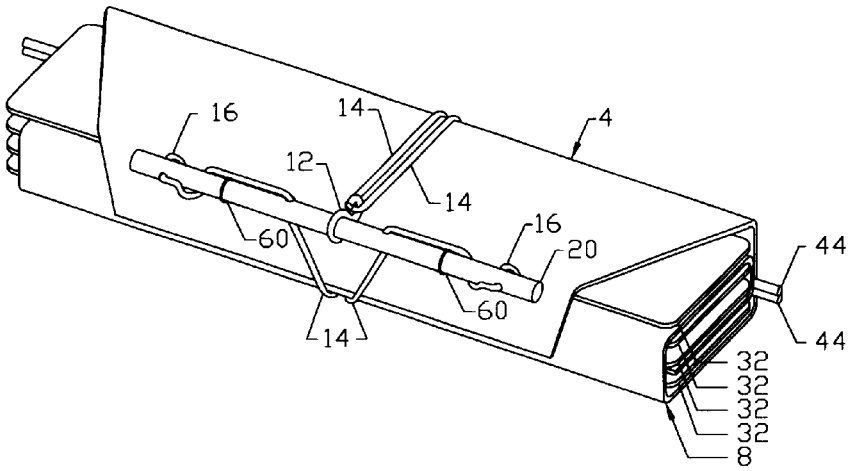
FIG. 5 is a perspective view of the portable storage apparatus of FIG. 1 folded for transport and storage.

In addition to FIG. 1, FIG. 3 depicts a detailed view of the rigid shelf 32. Three rear attachment points 64 are located on the back edge of each rigid shelf 32. There are two front support holes 68 at the leading edge of each rigid shelf 32. A shelf backing support rod 52 and the rigid shelves 32 attach to the fabric backing 8 by three shelf support stitches 48 at the three rear attachment points 64. This means of attachment allows the rigid shelves 32 to collapse into a folding position, as illustrated in FIG. 5.

FIG. 1 clearly shows a continuous cord 24 as it passes through each rigid shelf 32 at the front support holes 68 (FIG. 3) on the leading edge of each rigid shelf 32. Attached to the continuous cord 24 are cord locks 40. The cord locks 40 are located beneath the front support holes 68 on each rigid shelf 32. The rigid shelves 32 are held in their horizontal position by using the continuous cord 24 with the cord locks 40 allowing for shelf stability and for flexibility of the rigid shelf's 32 positioning.

Figure 2:
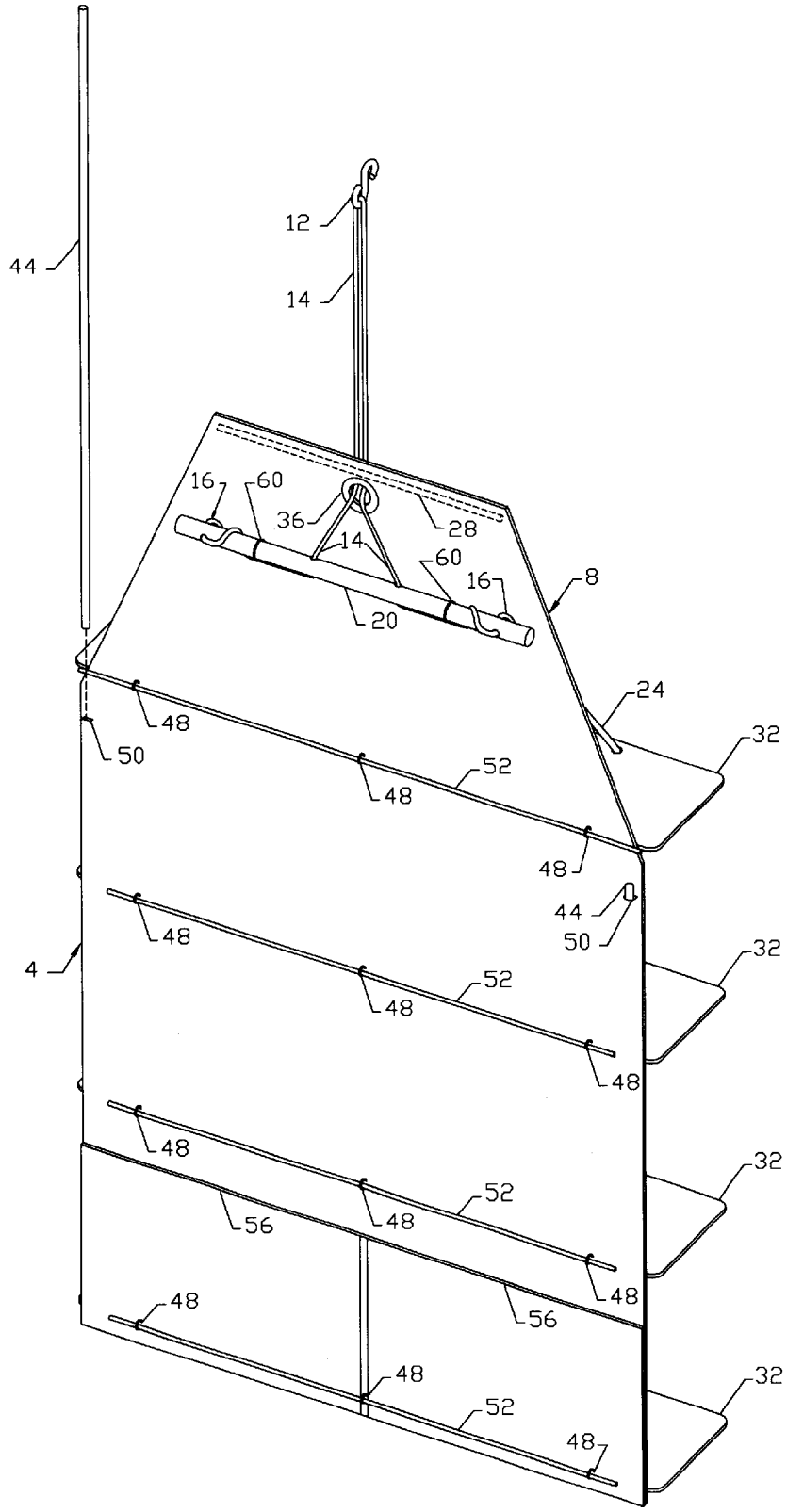
FIG. 2 is a rear elevational view of the portable storage apparatus of FIG. 1.
Figure 4:
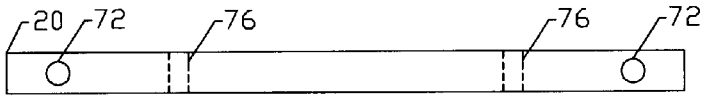
FIG. 4 is a detailed view of the support bar and its offset channels.

FIG. 1 and FIG. 2 depict the structural components and the interrelationship of the suspension system. Starting at the bottom of one side of the portable storage apparatus 4, the continuous cord 24 routes through the front support holes 68 on the rigid shelves 32 through the small grommet 16 fixed to the fabric backing 8 and to the support bar 20, which is detailed in FIG. 4, with two support bar stitches 60 anchoring the support bar 20 to the fabric backing 8. The continuous cord 24 passes through the support bar 20 at the horizontal support bar cord channel 72 wrapping around to the vertical support bar cord channel 76 and then through a large grommet 36. This method of routing holds the continuous cord 24 in place. After passing through the large grommet 36 attached to the fabric backing 8, the continuous cord 24 forms a loop creating an attachment point for the suspension system 14. The routing is then reversed moving back through the large grommet 36, to the other side of the support bar 20 where the continuous cord 24 moves through the vertical support bar cord channel 76 to the horizontal support bar cord channel 72 through the small grommet 16, and downward through each shelf's front support holes 68. The continuous cord 24, the support bar 20 and its various components, and the cord locks 40 comprise the suspension system 14. Its design is such to allow for adjustment of hanging height. A fixed "S" hook 12 is attached to the suspension system 14 providing for easy attachment to any stationary object.

FIG. 2 shows how each rigid shelf's 32 support system is augmented by inserting two vertical support rods 44 into the vertical support rod access channel 50 provided on the back side of the fabric backing 8, one on each side of the portable storage apparatus 4. These vertical support rods 44 can be inserted after the portable storage apparatus 4 is unrolled providing additional support and reinforcement to the fabric backing 8.

On the lower back side of the portable storage apparatus 4 there is a fold in the fabric backing 8 creating two pockets 56, which are used for additional storage of lightweight items.

As shown in FIG. 5, the portable storage apparatus 4 can be folded into a compact unit for convenient storage and transport by simply removing the two vertical support rods 44 and placing them on any rigid shelf 32.

Review of the description indicates a plurality of rigid shelves attached to a fabric backing with appropriate support that provides storage for items of varying size and shape. The use and placement of the shelves allows for easy access and visibility. The means of suspension of this invention allows for even distribution of the weight of the device itself and the stored articles, while also allowing for hanging-height adjustability. The design and structure of this portable storage apparatus allows it to fold easily into a compact shape providing for convenient storage and transport. The vertically placed support rods reinforce the area of fabric backing that is potentially weakened from repeated folding, thus increasing the life of the product and providing a more rigid structure. Those skilled in the art should now fully understand and appreciate how the present invention provides instant portable storage capabilities in any foreseeable situation. Any outdoorsman will benefit from having easy access to their gear at any given location by simply unrolling the portable storage apparatus and hanging it on the nearest stationary object.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended thereto.

LIST OF REFERENCE NUMERALS

| | |
|---|---|
| 4 | portable storage apparatus |
| 8 | fabric backing |
| 12 | "S" hook |
| 14 | suspension system |
| 16 | small grommet |
| 20 | support bar |
| 24 | continuous cord |
| 28 | forming rod with enclosure |
| 32 | rigid shelf |
| 36 | large grommet |
| 40 | cord lock |
| 44 | vertical support rod |
| 48 | shelf support stitch |
| 50 | vertical support rod access channel |
| 52 | shelf backing support rod |
| 56 | pocket |
| 60 | support bar stitch |
| 64 | shelf, rear attachment point |
| 68 | shelf, front support holes |
| 72 | support bar cord channel, horizontal |
| 76 | support bar cord channel, vertical |

What is claimed is:

1. A portable storage apparatus, comprising:

a plurality of rigid shelves, a fabric backing having a rectangular shape and a tapered top end cut to a predetermined dimension of sufficient size to house said plurality of rigid shelves having a rectangular shape of substantially equal length and a plurality of elongated support rods of varying dimensions all strategically anchored to said fabric backing a continuous cord of sufficient length routing through a plurality of points in said rigid shelves through a support bar at the top of the tapered end of said fabric backing with additional said continuous cord extending beyond the fabric backing on either side of the rigid shelves.

2. Said portable storage apparatus of claim 1 wherein said backing having a plurality of openings strategically placed toward the top part of the tapered end.

3. Said portable storage apparatus of claim 1 wherein the bottom portion of backing doubles backward and up attaching to said fabric backing at a predetermined point.

4. Said portable storage apparatus of claim 1 wherein said tapered top end folds backward housing a forming rod running horizontally the length of said fabric backing.

5. Said portable storage apparatus of claim 1 wherein said backing doubles over vertically on either side attaching to said fabric.

6. Said portable storage apparatus of claim 1 wherein the shelves are positioned at evenly spaced intervals along said fabric backing.

7. Said portable storage apparatus of claim 1 wherein the cord forms a loop at the top having a hook attached.

8. Said portable storage apparatus of claim 1 wherein said fabric backing having a backward fold at bottom of said fabric of sufficient size with a means of attachment forming pockets for storage said fabric backing cut to a predetermined dimension of sufficient size to house a plurality of rigid shelves having a rectangular shape of substantially equal length with a means for attachment to said fabric with appropriate spacing of said shelves permitting easy access and clear visibility of stored items a support bar and a plurality of support rods of varying dimension all strategically anchored to said fabric backing providing shelf support and suspension capabilities a continuous cord of sufficient length routing through a plurality of openings in the rigid shelves continuing to route through the support bar at top of the tapered end with additional said cord hanging below the last shelf providing a means for hanging-height adjustment.

9. Said portable storage apparatus of claim 8 wherein the means of attachment of the shelves to the fabric backing allows the portable storage apparatus to fold into a compact unit.

10. Said portable storage apparatus of claim 8 wherein the cord forms a loop at the top of the tapered end attached to a hook as a means for attachment to a stationary object.

11. Said portable storage apparatus of claim 8 wherein said support bar at the top of the tapered end provides means for support distributing the weight of the portable storage apparatus and stored items to a central location.

12. Said portable storage apparatus of claim 8 wherein the cord houses a cord lock attached at a plurality of locations under the shelves for a means of shelf adjustment and stability.

13. Said portable storage apparatus of claim 8 wherein a backward fold in the backing at the tapered top end houses a forming rod strategically placed to maintain shape.

14. Said portable storage apparatus of claim 8 wherein the backing houses vertical channels created by folds in the fabric of sufficient length for placement of support rods providing support to said storage apparatus and allowing for folding of said storage apparatus into compact unit once removed.

15. A method for storing various items, comprising:

providing a plurality of rigid shelves, providing a fabric backing of sufficient size to house said plurality of rigid shelves having a rectangular shape of substantially equal length with a means of attachment to said fabric backing and allowing for convenient placement of storage items providing a plurality of elongated support rods of varying dimensions with a means of attachment to the fabric backing supporting the rigid shelves and the fabric backing providing a continuous cord of sufficient length with a means for vertically hanging from a stationary object and allowing for adjustment of hanging height providing a means for folding into a compact unit for easy storage and transport.

16. The method of claim 15 including the step of providing a means for maintaining shape wherein said fabric has a tapered top end folding backwards forming an enclosure for placement of a forming rod.

* * * * *